US010786131B2

(12) United States Patent
Robinson et al.

(10) Patent No.: US 10,786,131 B2
(45) Date of Patent: Sep. 29, 2020

(54) MULTI-FUNCTIONAL CLEANING AND FLOOR CARE SYSTEM

(75) Inventors: Robert S. Robinson, Hamilton, OH (US); Joshua L. Harrell, Cincinnati, OH (US); Robert W. Kyde, Fairfield, OH (US); David W. Lloyd, Hamilton, OH (US); John T. Richter, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 906 days.

(21) Appl. No.: 13/563,718

(22) Filed: Jul. 31, 2012

(65) Prior Publication Data

US 2013/0139346 A1 Jun. 6, 2013

Related U.S. Application Data

(60) Provisional application No. 61/548,221, filed on Oct. 18, 2011, provisional application No. 61/513,662, filed on Jul. 31, 2011.

(51) Int. Cl.
*A47L 11/30* (2006.01)
*A47L 11/40* (2006.01)

(52) U.S. Cl.
CPC ..... *A47L 11/30* (2013.01); *A47L 11/4044* (2013.01); *A47L 11/4055* (2013.01)

(58) Field of Classification Search
CPC .. A47L 11/30; A47L 11/4044; A47L 11/4055; A47L 11/40
USPC ..... 15/320–322
See application file for complete search history.

(56) References Cited

U.S. PATENT DOCUMENTS

| | | | |
|---|---|---|---|
| 1,572,913 | A | 2/1926 | Finnell |
| 1,923,689 | A | 8/1933 | Rosenberg |
| 2,876,484 | A | 3/1959 | Wells |
| 3,063,082 | A | 11/1962 | Rosenberg |
| 3,118,165 | A | 1/1964 | Meyerhoefer |

(Continued)

FOREIGN PATENT DOCUMENTS

| | | |
|---|---|---|
| GB | 2322066 | 8/1998 |
| WO | 2009127836 | 10/2009 |

OTHER PUBLICATIONS

International Search Report (4 pages) for International Application No. PCT/US2012/049087, Eckenschwiller, A. (Authorized officer), dated Nov. 19, 2012, European Patent Office (International Searching Authority).

*Primary Examiner* — David Redding
(74) *Attorney, Agent, or Firm* — David E. Pritchard

(57) ABSTRACT

A multi-functional cleaning and floor care system may have: a fresh liquid reservoir; a vacuum assembly including a vacuum recovery tank and a vacuum motor assembly; a wheeled chassis configured to support at least one of the fresh liquid reservoir and the vacuum recovery tank; and a spigot fluidly connected to the fresh liquid reservoir, with the spigot adjustable between a fully open position and a fully closed position. The system also may have: a liquid spreader assembly connected to at least one of the fresh liquid reservoir, the vacuum assembly, and the wheeled chassis, with the liquid spreader assembly including a frame and a spreader pad; and a squeegee head assembly connected to at least one of the fresh liquid reservoir, the vacuum assembly, and the wheeled chassis, with the squeegee head assembly fluidly connectable to the vacuum recovery tank.

17 Claims, 10 Drawing Sheets

(56) References Cited

U.S. PATENT DOCUMENTS

| | | | | |
|---|---|---|---|---|
| 3,376,597 | A * | 4/1968 | Boyd | A47L 11/00 15/320 |
| 3,408,673 | A | 11/1968 | Oxel | |
| 3,550,181 | A | 12/1970 | Dolan et al. | |
| 3,939,518 | A | 2/1976 | Whitney et al. | |
| 4,200,951 | A | 5/1980 | Burgoon et al. | |
| 4,471,713 | A | 9/1984 | Cote et al. | |
| 4,809,396 | A | 3/1989 | Houser | |
| 4,961,246 | A | 10/1990 | Hauge et al. | |
| 5,109,791 | A | 5/1992 | Matsumoto et al. | |
| 5,287,581 | A | 2/1994 | Lo | |
| 5,319,828 | A | 6/1994 | Waldhauser et al. | |
| 5,377,382 | A | 1/1995 | Bores et al. | |
| 5,432,975 | A | 7/1995 | Hilmanowski | |
| 5,455,982 | A | 10/1995 | Armstrong et al. | |
| 5,613,270 | A | 3/1997 | Alvarez et al. | |
| 5,640,738 | A | 6/1997 | Williams et al. | |
| 5,735,959 | A | 4/1998 | Kubo et al. | |
| 5,846,334 | A | 12/1998 | Hoce | |
| 6,009,594 | A | 1/2000 | Grey | |
| 6,015,097 | A | 1/2000 | VanPutten | |
| 6,105,203 | A * | 8/2000 | Hueppi | A47L 11/30 15/320 |
| 6,524,386 | B1 | 2/2003 | Slager, Sr. | |
| 6,530,117 | B2 | 3/2003 | Peterson | |
| 6,741,054 | B2 | 5/2004 | Koselka et al. | |
| 6,766,556 | B2 | 7/2004 | Gergek | |
| 7,137,170 | B1 | 11/2006 | Morey et al. | |
| 7,185,389 | B2 | 3/2007 | Thomason et al. | |
| 7,302,733 | B2 | 12/2007 | Rau et al. | |
| 8,984,696 | B2 * | 3/2015 | Stuchlik | A47L 11/293 15/320 |
| 2002/0006307 | A1 * | 1/2002 | Feeny | A47L 11/30 403/2 |
| 2002/0007529 | A1 | 1/2002 | Legatt et al. | |
| 2003/0233729 | A1 | 12/2003 | Tucker | |
| 2005/0246853 | A1 * | 11/2005 | Pierce | A47L 11/302 15/320 |
| 2007/0240276 | A1 | 10/2007 | Pedlar | |
| 2010/0101033 | A1 * | 4/2010 | Fellhauer | A47L 11/16 15/49.1 |
| 2012/0137464 | A1 | 6/2012 | Thatcher et al. | |
| 2012/0151696 | A1 | 6/2012 | Hamblin et al. | |

* cited by examiner

MULTI-FUNCTIONAL CLEANING AND FLOOR CARE SYSTEM

CROSS-REFERENCE TO RELATED APPLICATIONS

This patent document claims the benefit of the filing date: of Provisional Application No. 61/513,662, entitled "Floor Care System Including Liquid Reservoir and Spreader" and filed on Jul. 31, 2011; and of Provisional Application No. 61/548,221, entitled "Floor Care System Including Liquid Reservoir, Spreader, and Vacuum" and filed on Oct. 18, 2011. The entire disclosure of each of Provisional Application No. 61/513,662 and Provisional Application No. 61/548,221 is incorporated into this patent document by reference.

FIELD OF THE INVENTION

This invention relates to cleaning and floor care machines, and more particularly, to multi-functional cleaning and floor care machines.

BACKGROUND OF THE INVENTION

Floors can be difficult and expensive to maintain. If not cared for properly, they not only become unsightly, they can drive customers away, cause slip and fall accidents, and even become a health hazard. Unfortunately, traditional mopping can make matters worse. Mopping is slow, ineffective, and even potentially dangerous—leaving floors slippery, wet, and with very few of the soils and biopollutants removed. Grouted floors are even trickier. In fact, during mopping, grout lines actually "squeegee" soil and soap scum from mops. When the water evaporates, soils, mineral deposits, soap scum, and potentially harmful biopollutants are left to penetrate and coat the porous grout. Grout lines that started out light gray or white soon become stained and darkened.

Traditional cleaning tools, like mops and wipes, remove very few soils, germs and other indoor pollutants. In fact, studies show they often simply spread them around. Then, workers end up crawling around on their hands and knees wiping soiled surfaces and fixtures by hand.

SUMMARY OF THE INVENTION

In one aspect of the invention, a multi-functional cleaning and floor care system may have a reservoir defining an interior space operable to hold a fresh cleaning liquid, a vacuum recovery tank, a vacuum motor assembly fluidly connected to the vacuum recovery tank; and a wheeled chassis configured to support at least one of the fresh liquid reservoir and the vacuum recovery tank. The system also may have a spigot fluidly connected to the reservoir interior space, with the spigot adjustable between a fully open position and a fully closed position, whereby when the reservoir contains a fresh cleaning liquid, a user may regulate the flow of the fresh cleaning liquid from the reservoir through the spigot by adjusting the spigot. In addition, the system may have: a liquid spreader assembly connected to at least one of the fresh liquid reservoir, the wet vacuum assembly, and the wheeled chassis, with the liquid spreader assembly including a frame and a spreader pad; and a squeegee head assembly connected to at least one of the fresh liquid reservoir, the wet vacuum assembly, and the wheeled chassis, the squeegee head assembly fluidly connectable to the vacuum recovery tank. The liquid spreader assembly may be operable to spread on a floor surface at least a portion of the fresh cleaning liquid from the reservoir, and the squeegee head assembly may be operable to vacuum at least a portion of the liquid on the floor surface into the vacuum recovery tank.

In another aspect of the invention, a multi-functional cleaning and floor care system may have a reservoir defining an interior space operable to hold a fresh cleaning liquid, a wheeled chassis configured to support the fresh liquid reservoir, and a spigot fluidly connected to the reservoir interior space, the spigot adjustable between a fully open position and a fully closed position, whereby when the reservoir contains a fresh cleaning liquid, a user may regulate the flow of the fresh cleaning liquid from the reservoir through the spigot by adjusting the spigot. In addition, the system may have a liquid spreader assembly connected to at least one of the fresh liquid reservoir and the wheeled chassis, with the liquid spreader assembly including a frame and a spreader pad. The liquid spreader assembly may be operable to spread on a floor surface at least a portion of the fresh cleaning liquid from the reservoir.

In a further aspect of the invention, a multi-functional cleaning and floor care system may have a reservoir defining an interior space operable to hold a fresh cleaning liquid, a vacuum recovery tank, a vacuum motor assembly fluidly connected to the vacuum recovery tank, and a wheeled chassis configured to support at least one of the fresh liquid reservoir and the vacuum recovery tank. The system also may have a spigot fluidly connected to the reservoir interior space, with the spigot adjustable between a fully open position and a fully closed position, whereby when the reservoir contains a fresh cleaning liquid, a user may regulate the flow of the fresh cleaning liquid from the reservoir through the spigot by adjusting the spigot. In addition, the system may have a squeegee head assembly connected to at least one of the fresh liquid reservoir, the wet vacuum assembly, and the wheeled chassis, with the squeegee head assembly fluidly connectable to the vacuum recovery tank. The squeegee head assembly also may be operable to vacuum at least a portion of the liquid on the floor surface into the vacuum recovery tank.

Additional aspects of the invention are directed to a liquid spreader assembly, or a squeegee head assembly, or a combination of a liquid spreader assembly and a squeegee head assembly—for use with a multi-functional cleaning and floor care system.

BRIEF DESCRIPTION OF THE DRAWINGS

The accompanying drawings, which are a part of this specification, illustrate embodiments of the invention. And together with the general description of the invention given above, and the detailed description of the drawings given below, the accompanying drawings explain the principles of the invention.

DETAILED DESCRIPTION OF THE DRAWINGS

To facilitate understanding of the invention, like reference numbers are used for like elements in the various embodiments described in detail below.

Figure 1:
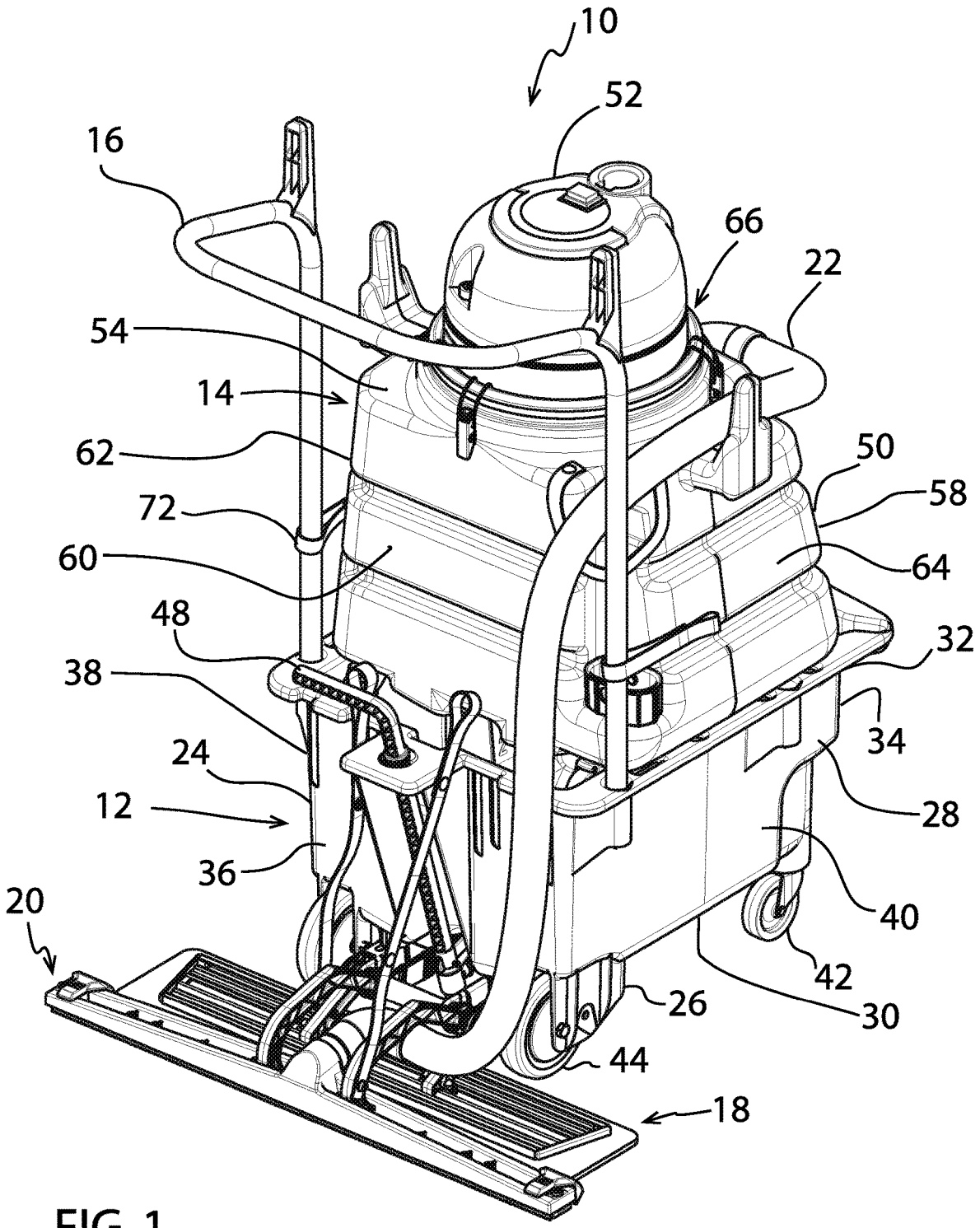
FIG. 1 is a perspective view of an embodiment of the multi-functional cleaning and floor care system, in accordance with the principles of the invention.

With reference to FIG. 1, the particular multi-functional cleaning and floor care system embodiment 10 shown comprises a fresh liquid reservoir assembly 12, a wet/dry vacuum assembly 14, a four-bend handle 16, a liquid spreader assembly 18, a squeegee head assembly 20, and a length of vacuum hose 22 fluidly connecting the squeegee head assembly to the wet/dry vacuum assembly.

Figure 7:
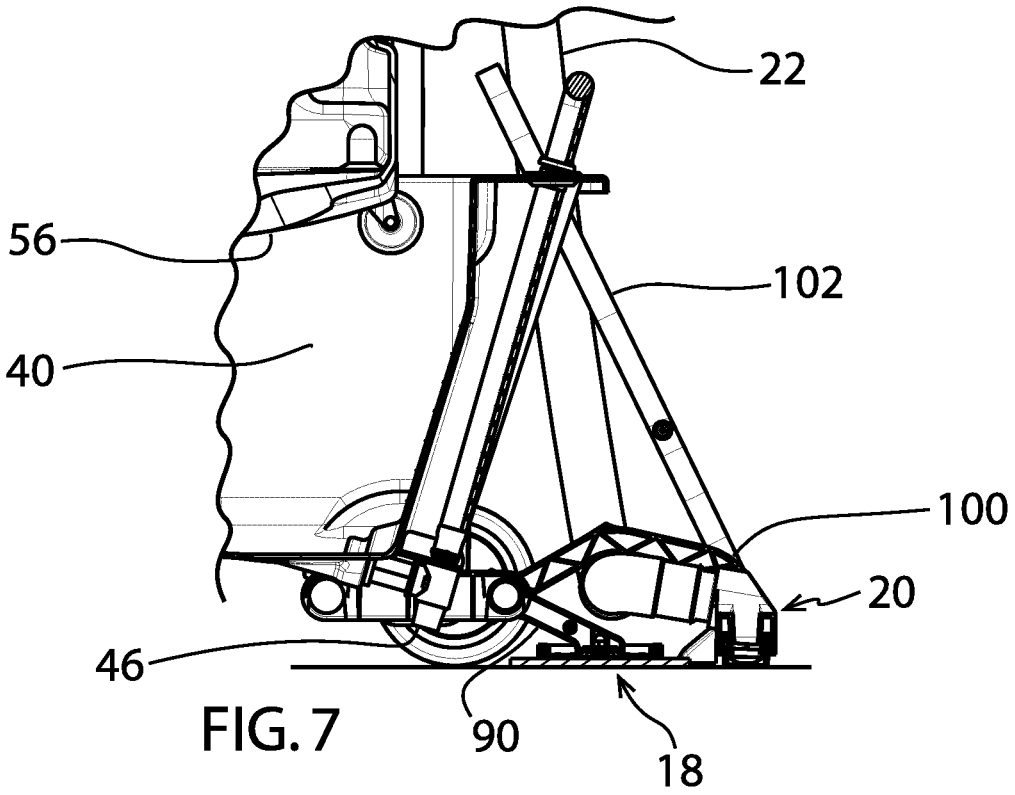
FIG. 7 is a cross-sectional view of a portion of the multi-functional cleaning and floor care system of FIG. 1, taken along line 7-7 of FIG. 6.
Figure 8:
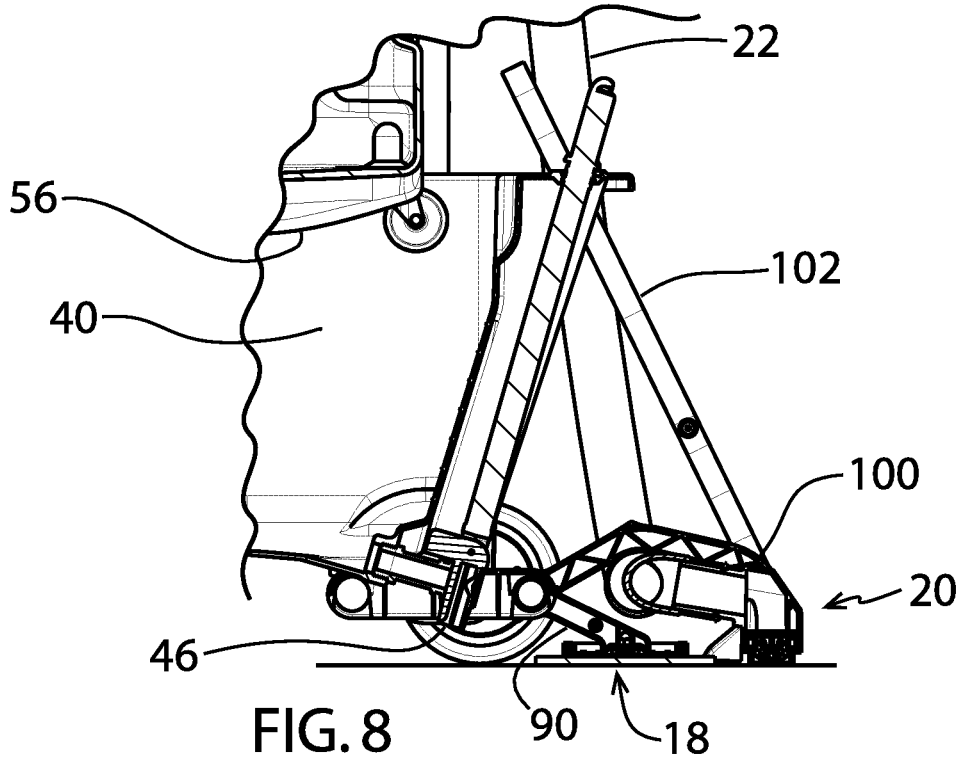
FIG. 8 is a cross-sectional view of a portion of the multi-functional cleaning and floor care system of FIG. 1, taken along line 8-8 of FIG. 6.

The fresh liquid reservoir assembly 12 has a reservoir 24 and a wheeled chassis 26 integral with the reservoir. The reservoir has a circumferential sidewall 28, (see, e.g., FIGS. 1 and 2), a bottom wall 30 (see, e.g., FIGS. 1, 2 and 5), and an upper end 32 (see, e.g., FIGS. 1-4)—with the circumferential sidewall including a front wall 34 (see, e.g., FIG. 1), a back wall 36 (see, e.g., FIG. 1), a left sidewall 38 (see, e.g., FIGS. 1-4), and a right sidewall 40 (see, e.g., FIGS. 1,7 and 8). The reservoir defines an interior space, and the reservoir upper end defines an opening—with the reservoir capable of holding a fresh cleaning liquid (e.g., water or another cleaning liquid or solution). The chassis includes the structure that supports the wheels. The reservoir assembly has four wheels—two swivel casters at the front (as at 42 in FIG. 1), and two fixed-axle wheels at the back (as at 44 in FIGS. 1, 9 and 10). At the front, the chassis includes a reinforced post or leg at the front lower-left corner, and a reinforced post or leg at the front lower-right corner. Each of these legs includes a cylindrical bore for receiving the post of the corresponding caster. At the back, the chassis includes a wheel frame at the back lower-left corner, and a wheel frame at the back lower-right corner. If desired, the reservoir and integral wheeled chassis also may be referred to as a trolley-bucket.

The reservoir assembly 12 further has a spigot 46 (see, e.g., FIGS. 6-8) fluidly connected to the reservoir interior space, with the spigot having a valve that is adjustable between a fully open position and a fully closed position. An extension arm 48 (see, e.g., FIG. 1) is connected to the spigot and includes an upwardly extending section. A user may operate the spigot between a fully open position and a fully closed position by rotating the extension arm. In this fashion, when the reservoir 24 contains a fresh cleaning liquid (e.g., water or another cleaning liquid or solution), a user may turn or rotate the extension arm, thereby adjusting the spigot valve and regulating the flow of the fresh cleaning liquid from the reservoir through the spigot.

With reference to FIG. 1, the wet/dry vacuum assembly 14 has a vacuum recovery tank 50 and a vacuum motor assembly 52 fluidly connected to the vacuum recovery tank. The vacuum motor assembly is positioned on top of the vacuum recovery tank, and is releasably fastened to the vacuum recovery tank with latches. The vacuum recovery tank has a top wall 54 (FIG. 1), a bottom wall 56 (FIGS. 2, 7 and 8), a front wall 58 (FIG. 1), a back wall 60 (see, e.g., FIGS. 1 and 2), a left sidewall 62 (see, e.g., FIG. 1), and a right sidewall 64 (see, e.g., FIG. 1). A suction inlet 66 (FIG. 1) is located toward the top of the front wall; and a discharge outlet (not shown) is located at the bottom of the front wall. Four swivel caster wheels (as at 70, FIG. 2) extend downward from the bottom wall.

The wet/dry vacuum assembly 14 is removably positioned on top of the reservoir 24, and the four-bend handle 16 is removably connected to the reservoir. A strap assembly (as at 72 in FIG. 1) on each side of the vacuum recovery tank 50 releasably connects the wet/dry vacuum assembly to the four-bend handle. The wet/dry vacuum assembly is transportable on the reservoir. In addition, each of the reservoir assembly and the wet/dry vacuum assembly is operable both when the wet/dry vacuum assembly is positioned on top of the reservoir, and when the wet/dry vacuum assembly is separated from the reservoir.

The reservoir assembly 12 is further shown and described in commonly-owned U.S. Patent No. 8,544,141, entitled "Cleaning Cart Systems" and issued on Oct. 1, 2013, and in commonly-owned U.S. patent application Ser. No. 13/477,040, entitled "Modular Multi-Functional Cleaning and Floor Care System" and filed on May 21, 2012. in addition, the wet/dry vacuum assembly 14, and the interaction between the reservoir assembly and the wet/dry vacuum assembly, are further shown and described in commonly-owned U.S. patent application Ser. No. 13/477,040, The entire disclosure of each of U.S. Patent No. 8,544,141 and U.S. patent application Ser. No. 13/477,040 is incorporated into this patent document by reference.

Figure 2:
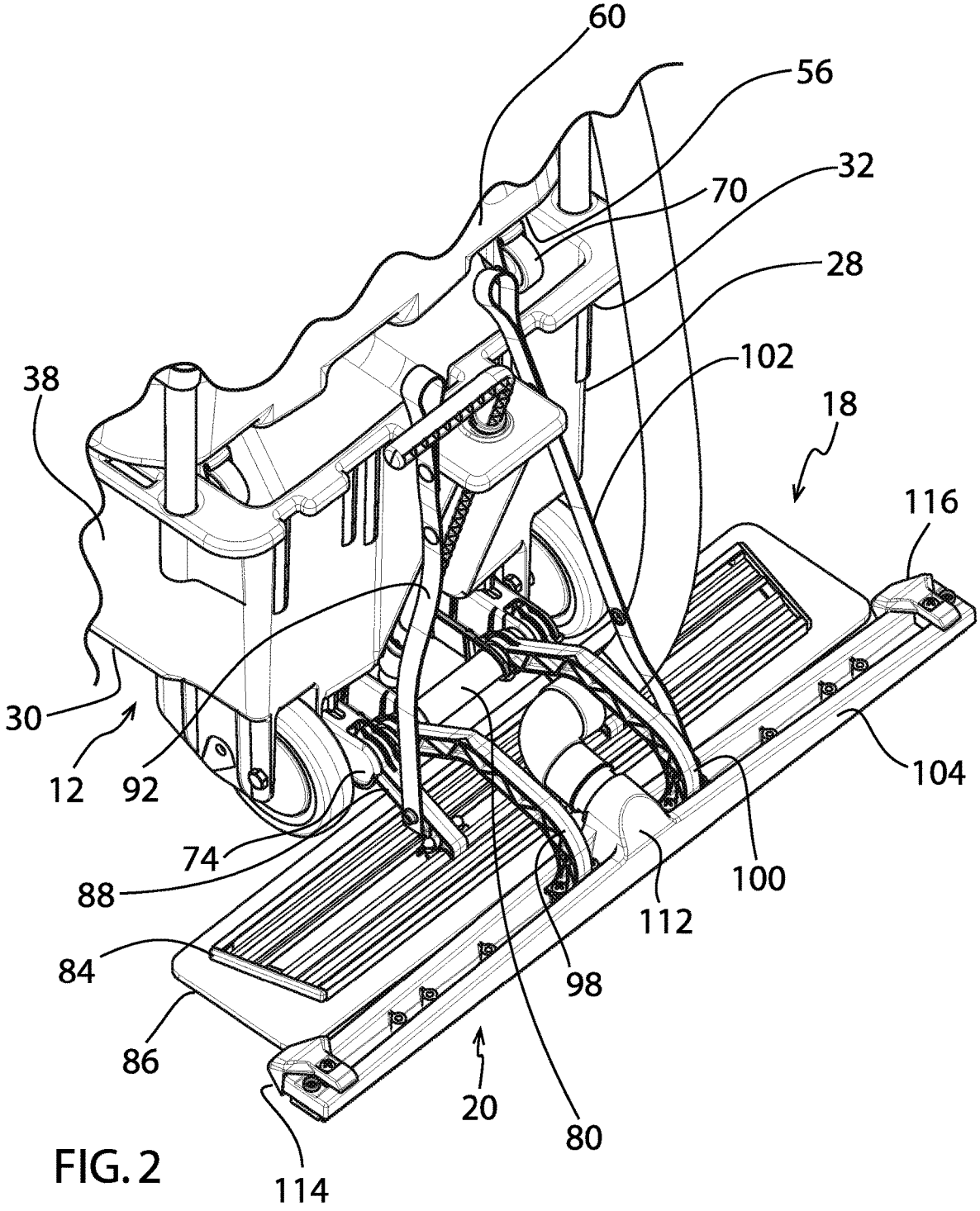
FIG. 2 is a perspective view of a portion of the multi-functional cleaning and floor care system of FIG. 1.

With reference to FIG. 2, the liquid spreader assembly 18 and the squeegee head assembly 20 are releasably connected to the fresh liquid reservoir assembly 12 via a hitch assembly 74. The hitch assembly is connected to the reservoir bottom wall 30 at the back of the reservoir 24, and extends rearward from the reservoir assembly.

Figure 6:
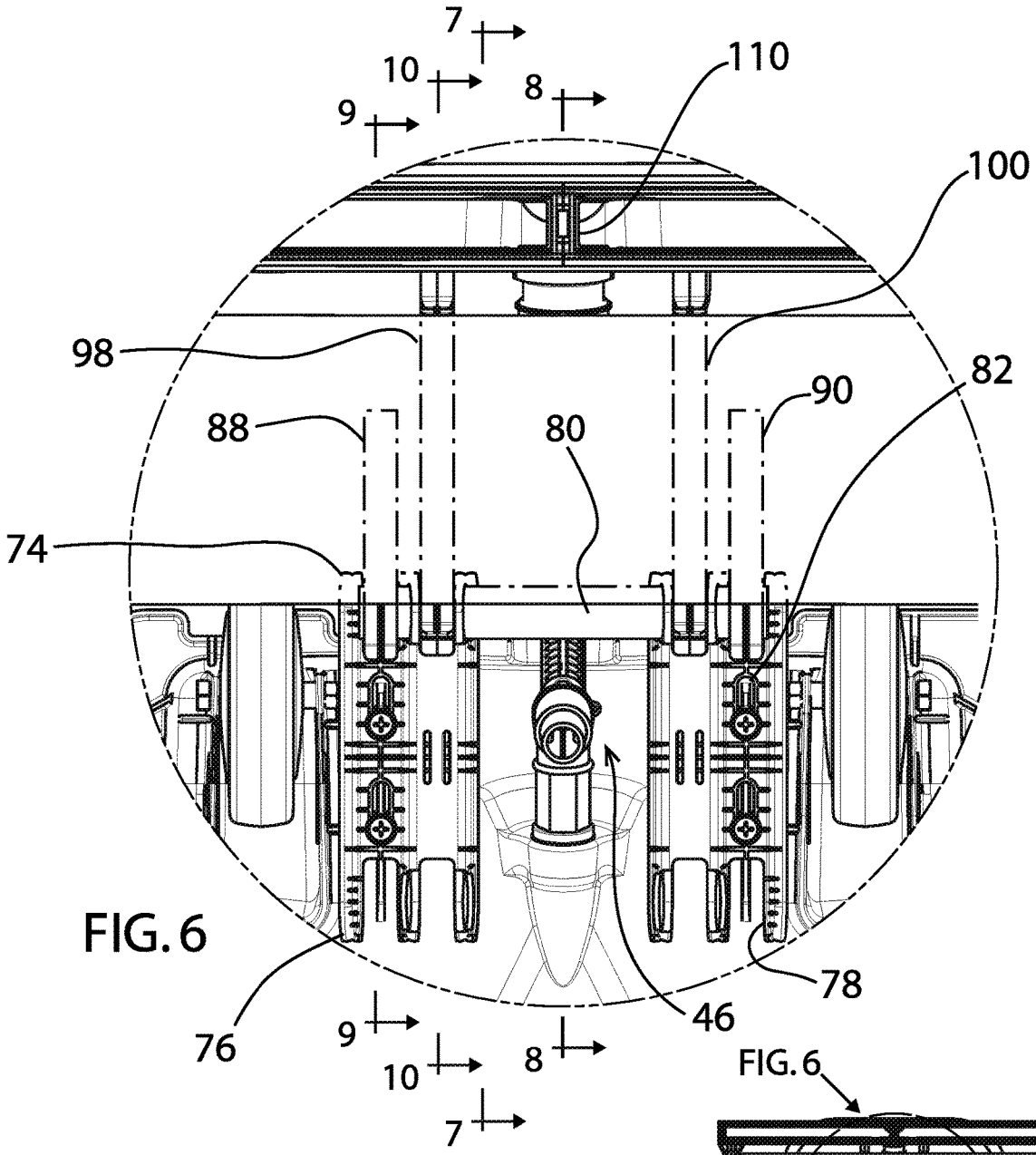
FIG. 6 is a portion of the bottom view of FIG. 5, enlarged for magnification purposes.

As seen in FIGS. 2 and 6, the hitch assembly 74 has a pair of parallel brackets 76, 78 (FIG. 6) and a crossbar 80 mounted at the exterior surface of the reservoir bottom wall 30. Bracket 76 (see e.g., FIGS. 6, 9, and 10) is positioned between the left rear wheel and the spigot 46, and bracket 78 is positioned between the right rear wheel and the spigot. As seen in FIG. 6, the bottom wall of each bracket has a pair of longitudinal slots (as at 82), so that each bracket may be adjusted forward and aft as desired. The crossbar 80 is circular in cross-section, and is held in position by the brackets.

Figure 3:
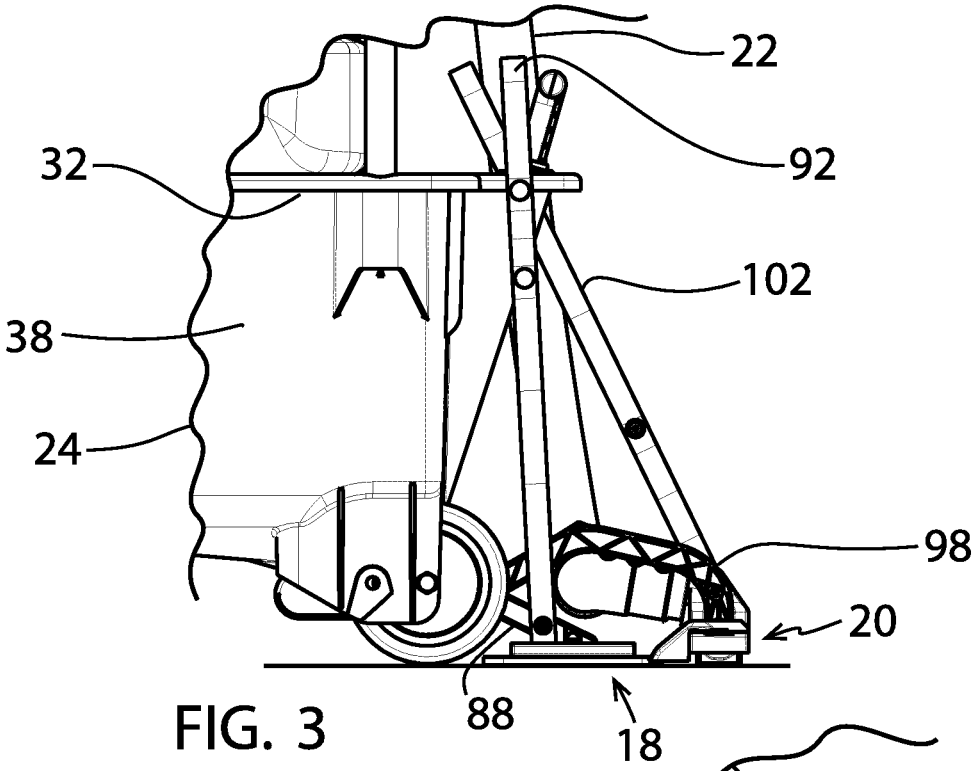
FIG. 3 is a left side view of a portion of the multi-functional cleaning and floor care system of FIG. 1.
Figure 4:
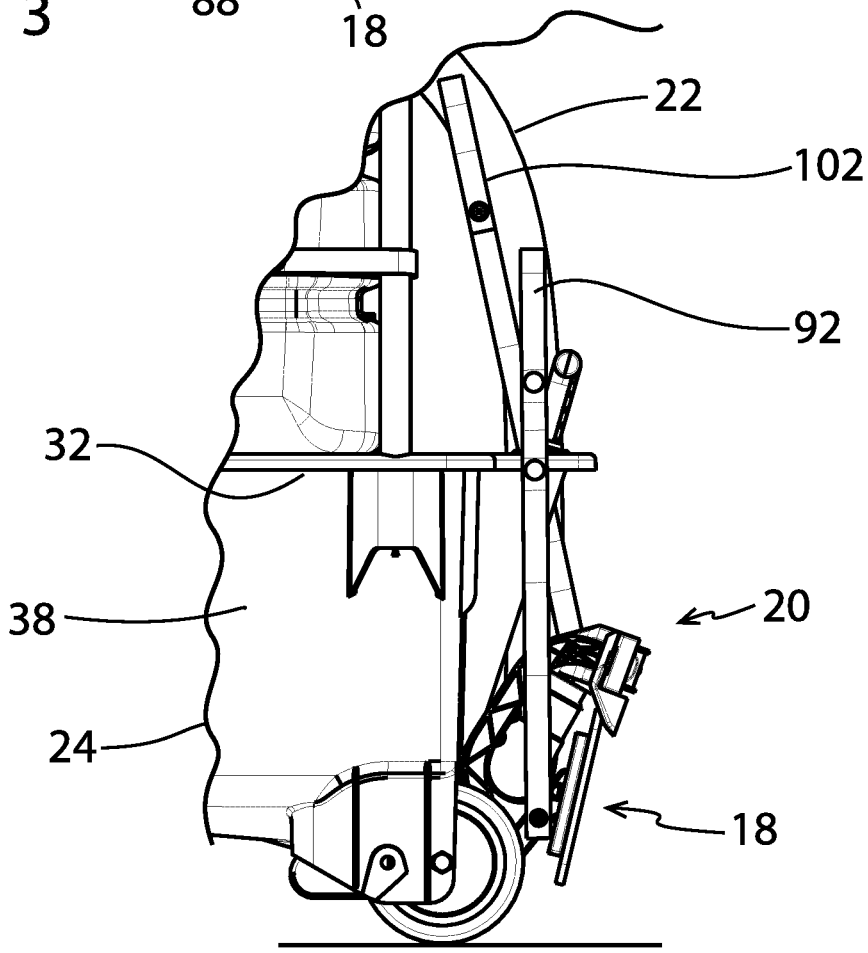
FIG. 4 is another left side view of a portion of the multi-functional cleaning and floor care system of FIG. 1, with the liquid spreader assembly and the squeegee vacuum head assembly shown in an up position.
Figure 5:
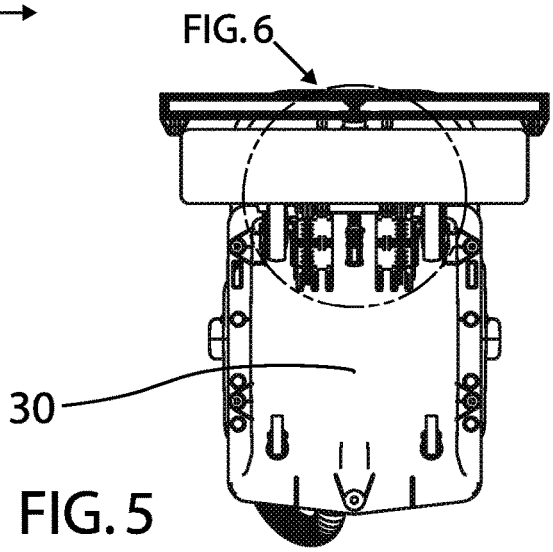
FIG. 5 is a bottom view of the multi-functional cleaning and floor care system of FIG. 1.
Figure 9:
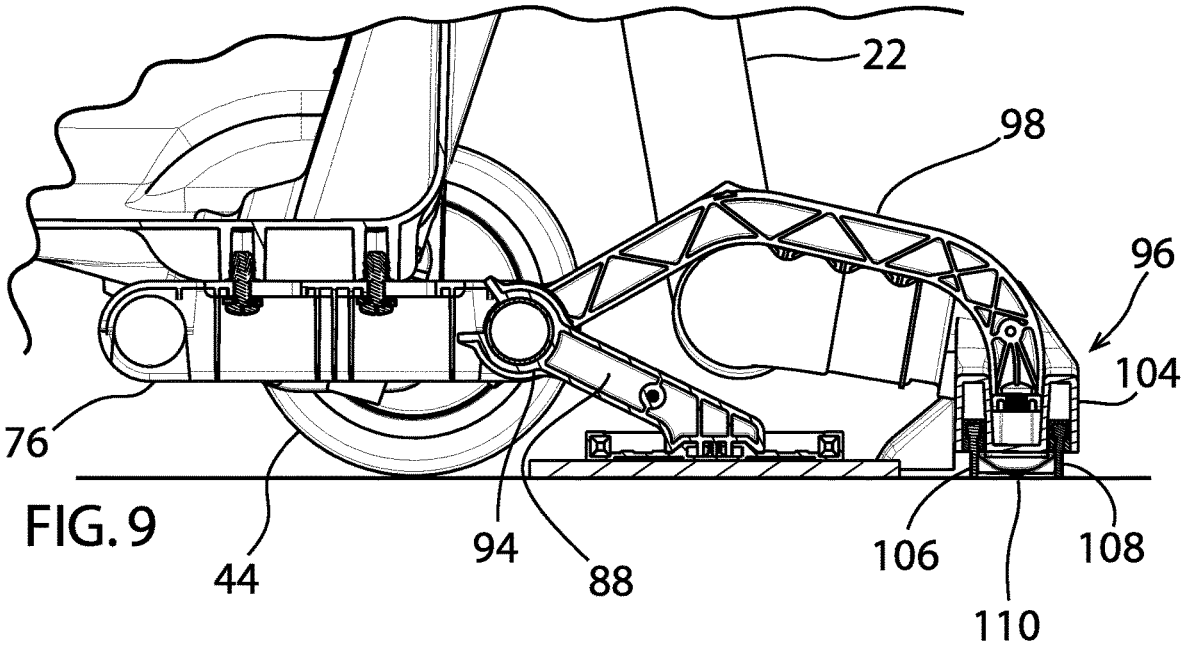
FIG. 9 is a cross-sectional view of a portion of the multi-functional cleaning and floor care system of FIG. 1, taken along line 9-9 of FIG. 6.

The liquid spreader assembly 18 has a frame 84, a spreader pad 86 releasably attached to a bottom surface of the frame, a pair of connecting arms 88, 90, (see, e.g., FIGS. 6, 9, and 10), and a strap 92 (see, e.g., FIGS. 2-4). These items may be made of any suitable materials. The pad may be releasably attached to the frame using any suitable material(s) or method(s). For example, the frame bottom surface may have one or more strips of hook-type fasteners (of the hook-and-loop variety) that engage an upper surface of the pad. The pad may be any suitable pad, with one example being a microfiber pad. One end of each connecting arm is attached to an upper surface of the frame; and the other end is releasably and rotatably attached to the crossbar 80. As best seen in FIG. 9, the crossbar-engaging end 94 of connecting arm 88 includes an integral resilient generally C-shaped member that releasably snap-fits onto and around the crossbar. In similar fashion, the crossbar-engaging end of connecting arm 90 includes an integral resilient generally C-shaped member (not shown) that releasably snap-fits onto and around the crossbar. As best seen in FIGS. 2-4, the strap 92 has male and female snap members along its length. The lower portion of the strap is affixed to connecting arm 88; and female snaps at different locations along an upper portion of the strap may be releasably connected to a male snap (not shown) at a rear wall member to the left of the extension arm, at the back of the reservoir 24.

Depending on the particular upper portion female snap selected, a user may put the liquid spreader assembly 18 in a down position (see, e.g., FIG. 3) or in an up position (FIG. 4). When the liquid spreader assembly is in the down position, the spreader pad 86 is in a floor contacting relationship with a floor surface. When the liquid spreader assembly is in the up position, the spreader pad is in a non-contacting relationship with the floor surface (FIG. 4). A user may install or remove the liquid spreader assembly quickly and easily, without the use of any tools. To install the assembly, the user aligns the open portion of the C-shaped member of each connecting arm 88, 90 with the crossbar 80, exerts a pushing force on the arms thereby snap-fitting the C-shaped members onto the crossbar, and fastens the upper portion of the strap 92 to the reservoir 24. To remove the assembly, the user may unfasten the upper portion of the strap, and then exert a pulling force on the arms to release the arms from the crossbar.

The squeegee head assembly 20 has a frame assembly 96 (see, e.g., FIGS. 9 and 10), a pair of connecting arms 98, 100 (see, e.g., FIGS. 2, 3, and 6-10), and a strap 102 (see, e.g., FIGS. 2-4, 7, and 8). These items may be made of any suitable materials. The frame assembly has a frame 104 (see, e.g., FIGS. 2, 9, and 10), squeegee blades (as at 106 and 108 in FIGS. 9 and 10), and wheels (as at 110 in FIGS. 6, 9, and 10) along the length of the frame. The frame has a front, a back, a top, a first end, a second end, and a crown 112 (see, e.g., FIG. 2). A first row of squeegee blades (aligned end-to-end) depends from the front; and a second row of squeegee blades (aligned end-to-end) depends from the back. A tube segment of circular cross-section extends from the crown and serves to define a suction outlet for the assembly. The tube segment also serves as a connector, by which a user can releasably connect (e.g., via a friction fit) the assembly to an end portion of a length of vacuum hose—with the other end of the length of vacuum hose being releasably connectable to the suction inlet of the vacuum recovery tank.

In addition, the squeegee head assembly 20 has a plow member 114, 116 (see, e.g., FIG. 2) at each of the frame first and second ends. Each plow member has a first section that extends forward and down from the frame front, and a second section integral with the first section, the second section extending across the top of the frame, from the frame front toward the frame back. Each plow member can be helpful in facilitating power cord management. For example, if a user pushes or pulls the system 10 in a direction such that the squeegee head assembly trails behind the spigot, and a portion of a power cord is located to the left or right of the reservoir assembly but within the path of a laterally extending portion of the squeegee head assembly, the plow facilitates smooth movement of the power cord portion—either up and over the squeegee head assembly, or laterally away from the squeegee head assembly.

Figure 10:
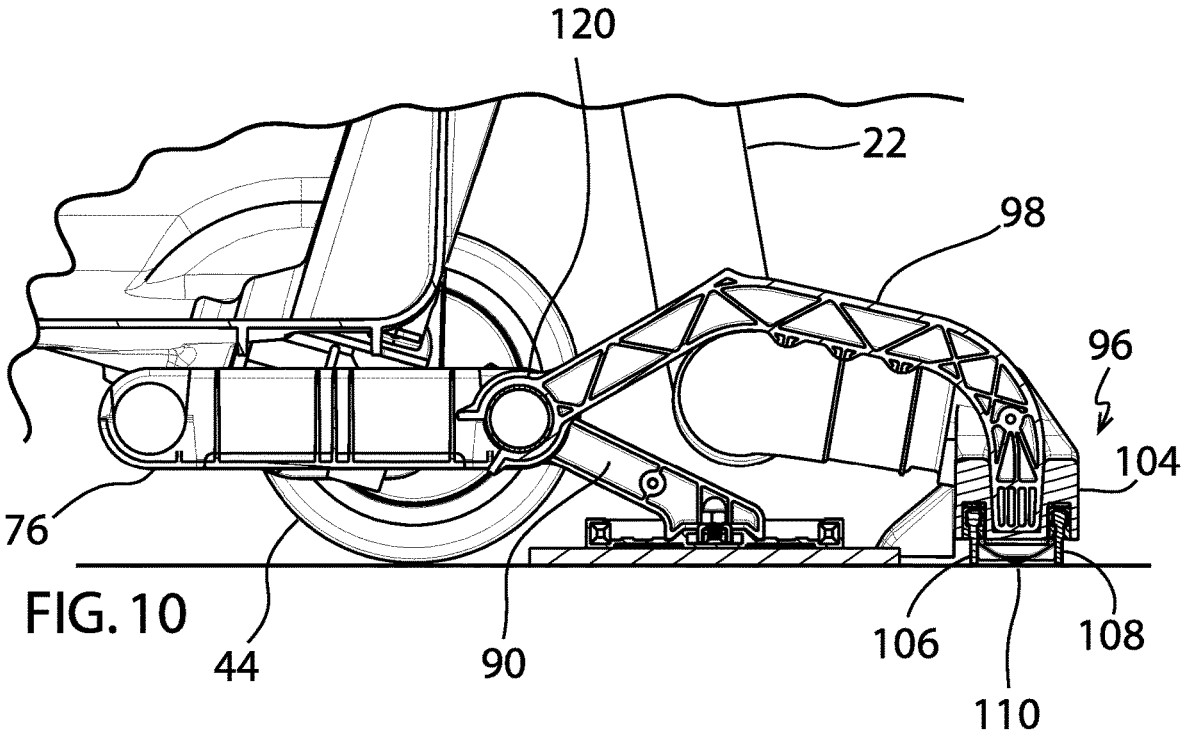
FIG. 10 is a cross-sectional view of a portion of the multi-functional cleaning and floor care system of FIG. 1, taken along line 10-10 of FIG. 6.

One end of each connecting arm 98, 100 is attached to an upper surface of the squeegee head assembly frame 104; and the other end is releasably and rotatably attached to the crossbar 80. As best seen in FIG. 10, the crossbar-engaging end 120 of connecting arm 98 includes an integral resilient generally C-shaped member that releasably snap-fits onto and around the crossbar. In similar fashion, the crossbar-engaging of connecting arm 100 includes an integral resilient generallt C-shaped member (not shown) that releasably snap-fits onto and around the cross-bar. As best seen in FIGS. 1-4, the strap 102 has male and female snap members along its length. The lower portion of the strap is affixed to connecting arm 100; and female snaps at different locations along upper portions of the strap may be releasably connected to a male snap (not shown) at a rear wall member to the right of the extension arm, at the back of the reservoir 24.

Depending on the particular upper portion female snap selected, a user may put the squeegee head assembly 20 in a down position (see, e.g., FIG. 3)or in an up position (FIG. 4). When the squeegee head assembly is in the down position, the first and second rows of squeegee blades are in a floor contacting relationship with a floor surface. When the squeegee head assembly is in the up position, the first and second rows are in a non-contacting relationship with the floor surface (FIG. 4). A user may install or remove the squeegee head assembly quickly and easily, without the use of any tools. To install the assembly, the user aligns the open portion of the C-shaped member of each connecting arm 98, 100 with the crossbar 80, exerts a pushing force on the arms thereby snap-fitting the C-shaped members onto the crossbar, and fastens an upper portion of the strap 102 to the reservoir 24. To remove the assembly, the user may unfasten an upper portion of the strap, and then exert a pulling force on the arms to release the arms from the crossbar.

In use, the user may open the reservoir spigot and turn on the wet-dry vacuum. Then the user may pull or push the multi-functional cleaning and floor care system (e.g., in a serpentine pattern) over the floor surface to be cleaned. As the user pulls or pushes the system along, cleaning solution is dispensed, spread, and vacuumed in one easy step.

The modular design of the multi-functional cleaning and floor care system allows for quick and easy part replacement and changing from one cleaning mode to another. The design makes this process as simple as snapping on and snapping off. The modular design also allows the user to shift quickly and easily between a spread-only mode, a vacuum-only mode, and a spread-and-vacuum mode.

The connecting arms are designed so that, if a user catches part of the liquid spreader assembly or squeegee head assembly on an obstacle (e.g., a corner of wall or heavy table), the connecting arms may detach (i.e., snap off) from the hitch—thereby preventing the liquid spreader assembly and the squeegee head assembly from breaking. Also, the connecting arms are designed to have some degree of twist; in this fashion, if either end of the squeegee head assembly frame brushes up against an obstacle, the squeegee head assembly can flex to get around the obstacle.

The connecting arms are free to rotate around the hitch. This allows the arms to be rotated and stored in the upwardmost position. In the upward position, the user can easily have access to the spreader pad (e.g., a microfiber pad) for replacement. The rigid design of the connecting arms allows the user to either pull or push the floor care system. This allows easy maneuvering into tight spaces and backing into corners or edges. If needed or desired in order to clean an edge or alcove, the user can disconnect the vacuum hose from the floor tool assembly and quickly attach the vac hose to a vacuum wand for trimming and cleaning these hard to reach areas.

The wet-dry vacuum of the multi-functional cleaning and floor care system may be powered in any suitable way. For example, the vacuum motor assembly may be connected to an electrical outlet (e.g., a wall outlet) via a power cord. Alternatively, the system may include a battery or the like.

In use, the multi-functional cleaning and floor care system may be used for a wide variety of floor care needs. For example, the system may be used to apply a general-purpose cleaning solution, a stripping solution, a disinfectant, or a degreasing solution. The system may be used, e.g., for daily floor cleaning, stripping floors, and finishing floors. Also, the system may be used in any of a number of locations and facilities, e.g., hallways, lobbies, cafeterias, gymnasiums, warehousing, shop floors, healthcare, and retail.

In use, a multi-functional cleaning and floor care system, in accordance with the principles of the invention, may be operated in a number of different configurations and ways—determined largely by the particular cleaning- or other floor care-activity to be performed.

For example, for general or routine cleaning, a user may fill the reservoir with cleaning solution, put the liquid spreader assembly and the squeegee head assembly in the down position, open the spigot to dispense cleaning solution, turn on the vacuum motor, and start cleaning. If extra dwell time is desired—for example, for heavy soil situations or for disinfection purposes—the user can simply raise the squeegee head assembly to the up position, and leave the liquid spreader assembly in place in the down position. In this manner, the system will disperse a thin uniform layer of solution as it leaves the spigot. Then, if desired, after a sufficient amount of dwell time, the user may simply lower the squeegee head assembly to the down position and vacuum up the solution.

If a user wants to apply and remove a floor stripper solution, the system allows them to do so in a highly productive manner. For example, to apply the solution, the user may move the four-bend handle to the front of the reservoir assembly, move the squeegee head assembly to the up position, keep the liquid spreader assembly in the down position, open the spigot, and pull the system (i.e., with the liquid spreader assembly trailing behind the spigot). To vacuum up the stripper solution, the user may remove the liquid spreader assembly, lower the squeegee head assembly to the down position, turn on the vacuum motor, and push the system (i.e., with the squeegee head assembly and the back of the liquid reservoir now leading (i.e., the reservoir back now being at the front), and the front of the liquid reservoir now trailing behind the back. In this way, the user does not walk through the stripper solution—either in applying or removing the solution.

Additional embodiments and configurations of the multi-functional cleaning and floor care system of the present invention are described in further detail below. And as noted above, to facilitate understanding of the invention, like reference numbers are used for like elements across the various embodiments.

Figure 11:
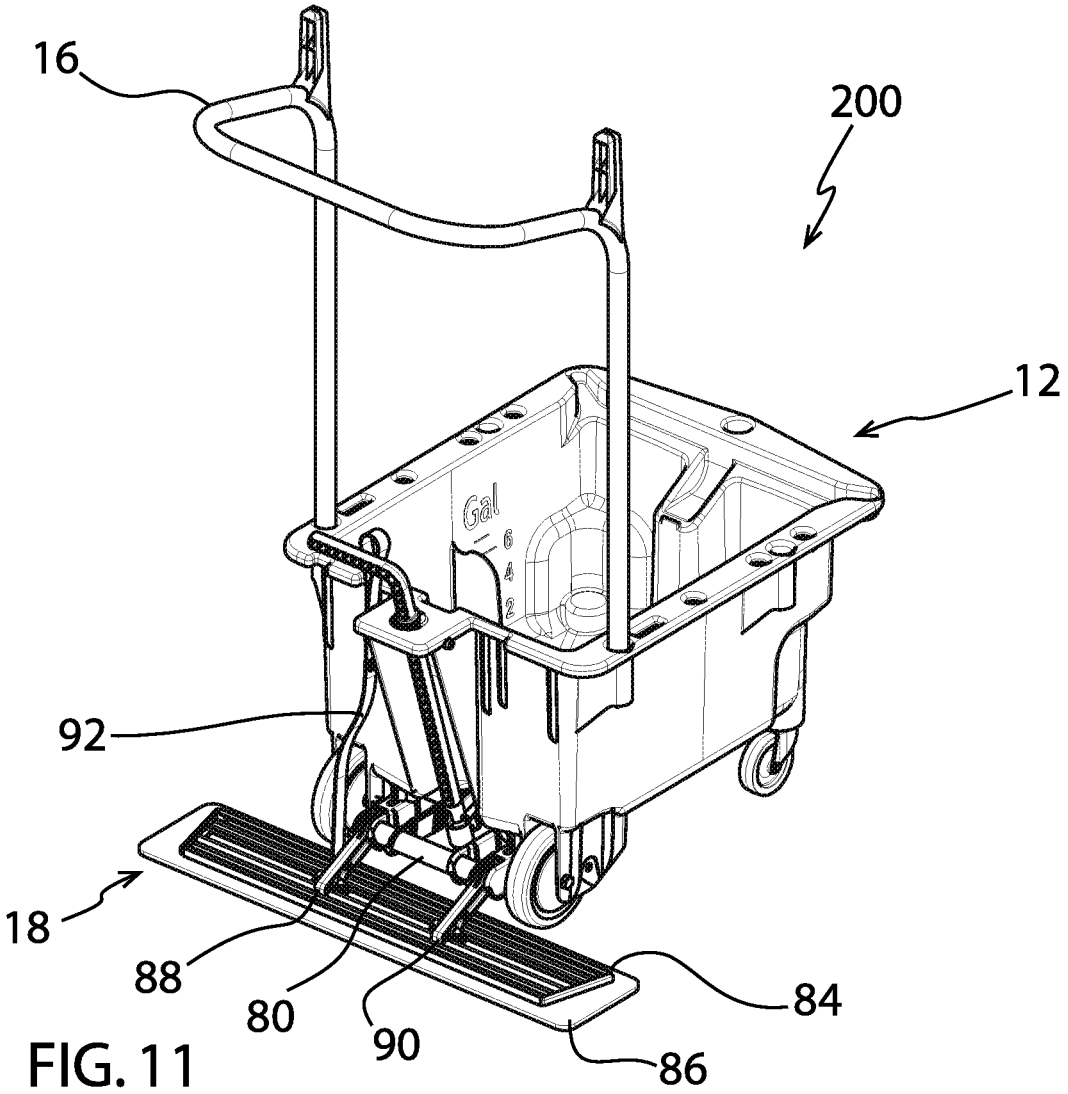
FIG. 11 is a perspective view of another embodiment of the multi-functional cleaning and floor care system, in accordance with the principles of the invention.
Figure 12:
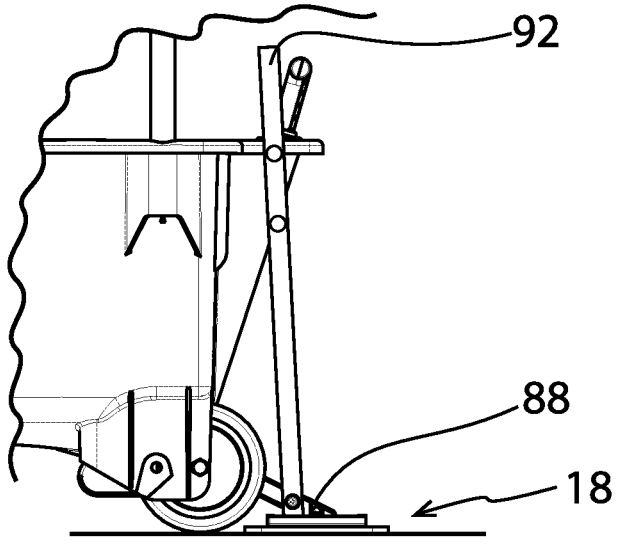
FIG. 12 is a left side view of a portion of the multi-functional cleaning and floor care system of FIG. 11.
Figure 13:
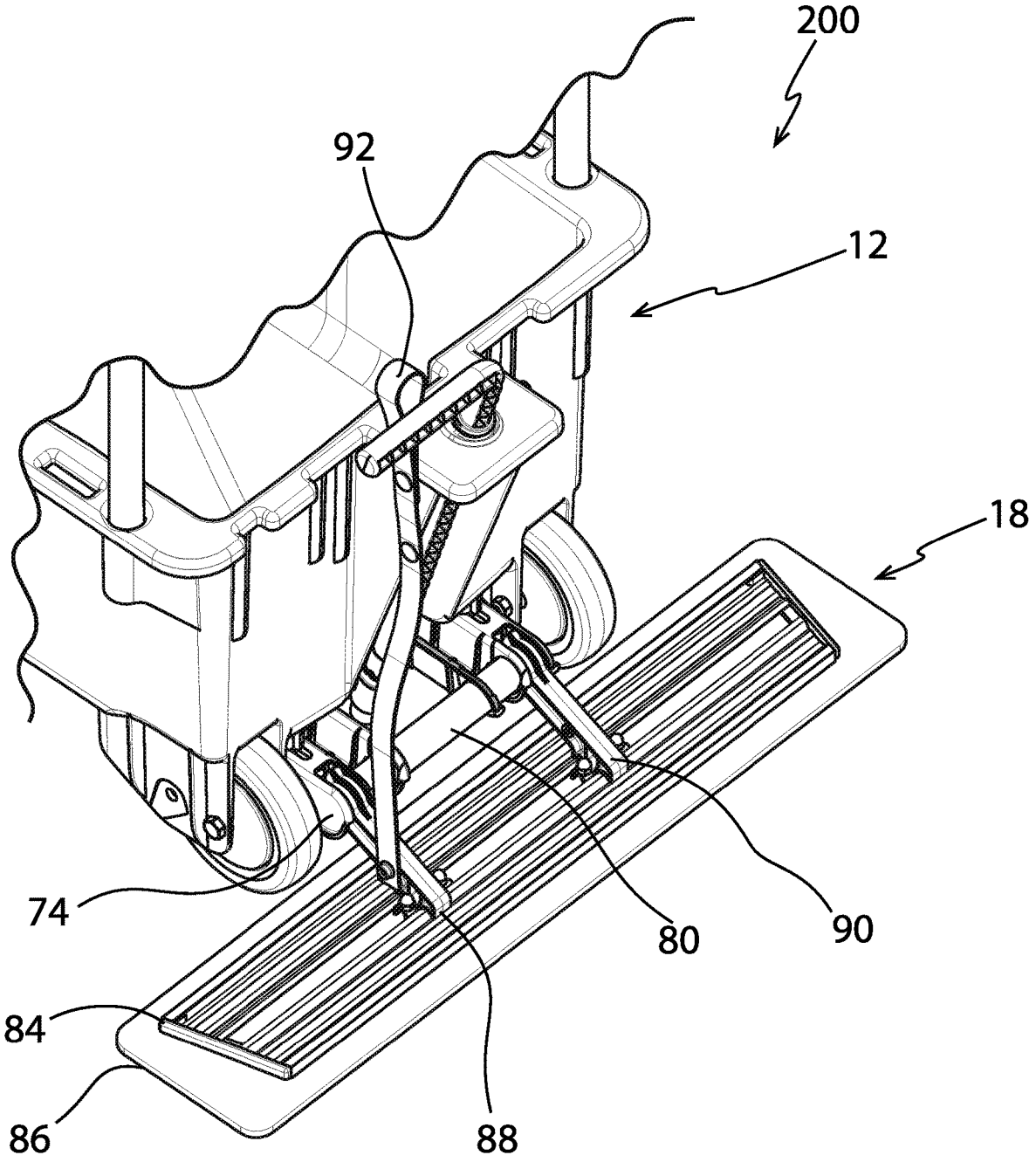
FIG. 13 is a perspective view of a portion of the multi-functional cleaning and floor care system of FIG. 11.

With reference to FIGS. 11-13, the particular multi-functional cleaning and floor care system embodiment 200 shown is identical to system 10 (shown in FIGS. 1-10), except that system 200 does not include the wet/dry vacuum assembly, the squeegee head assembly, and the length of vacuum hose.

Figure 14:
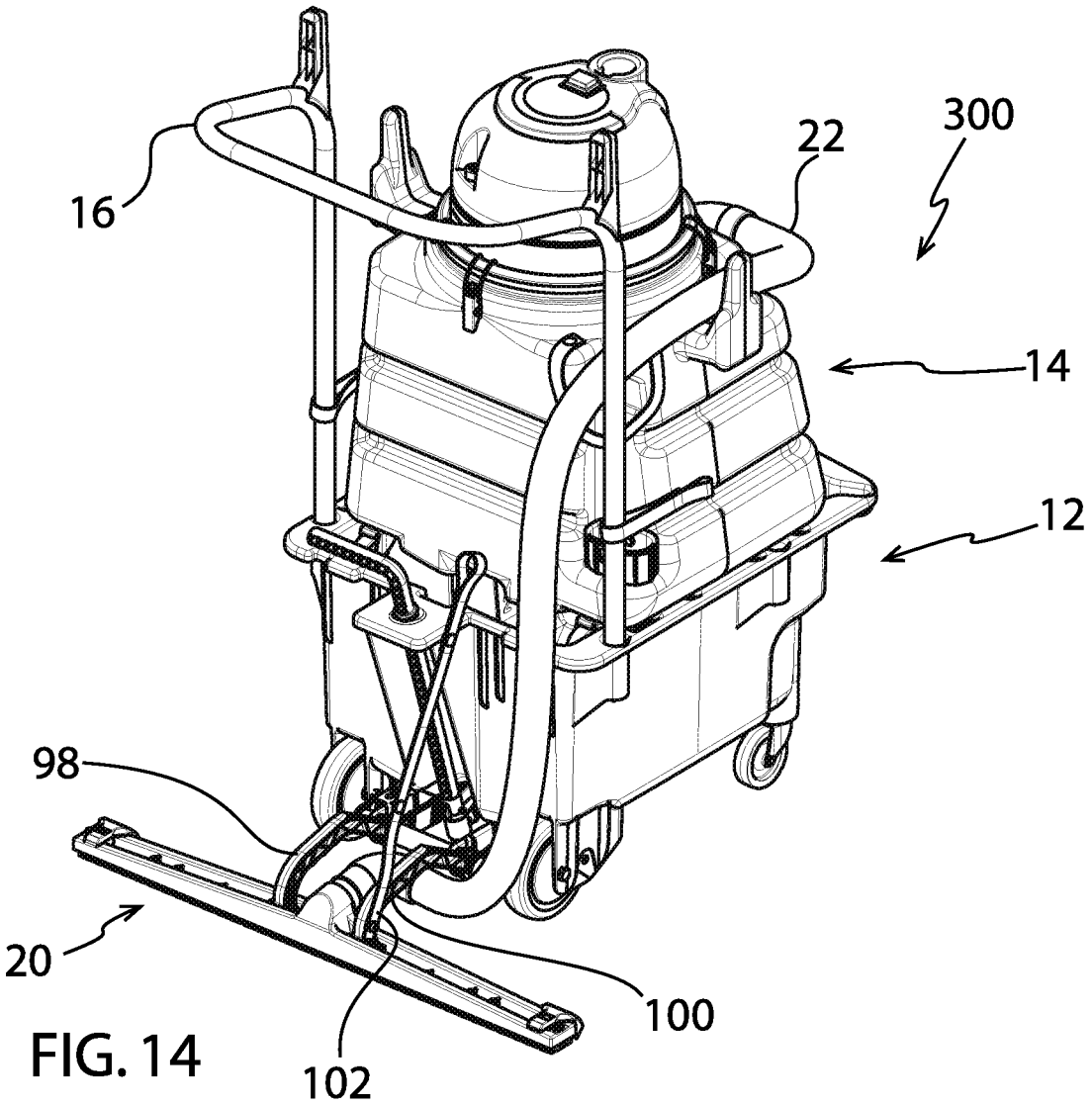
FIG. 14 is a perspective view of a further embodiment of the multi-functional cleaning and floor care system, in accordance with the principles of the invention.
Figure 15:
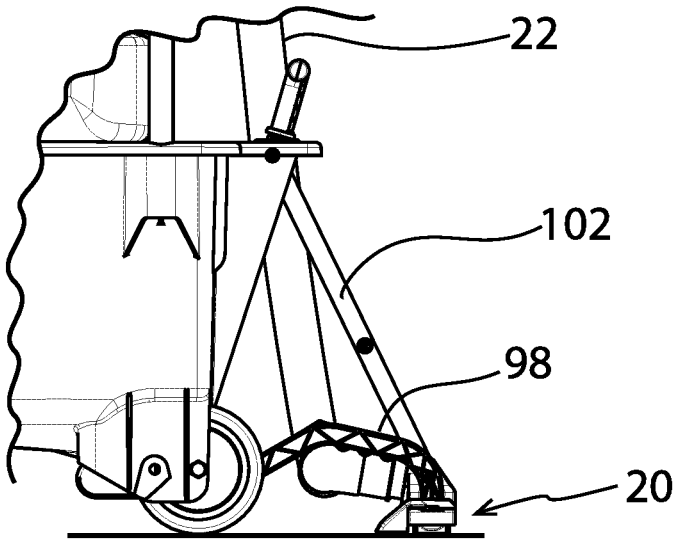
FIG. 15 is a left side view of a portion of the multi-functional cleaning and floor care system of FIG. 14.
Figure 16:
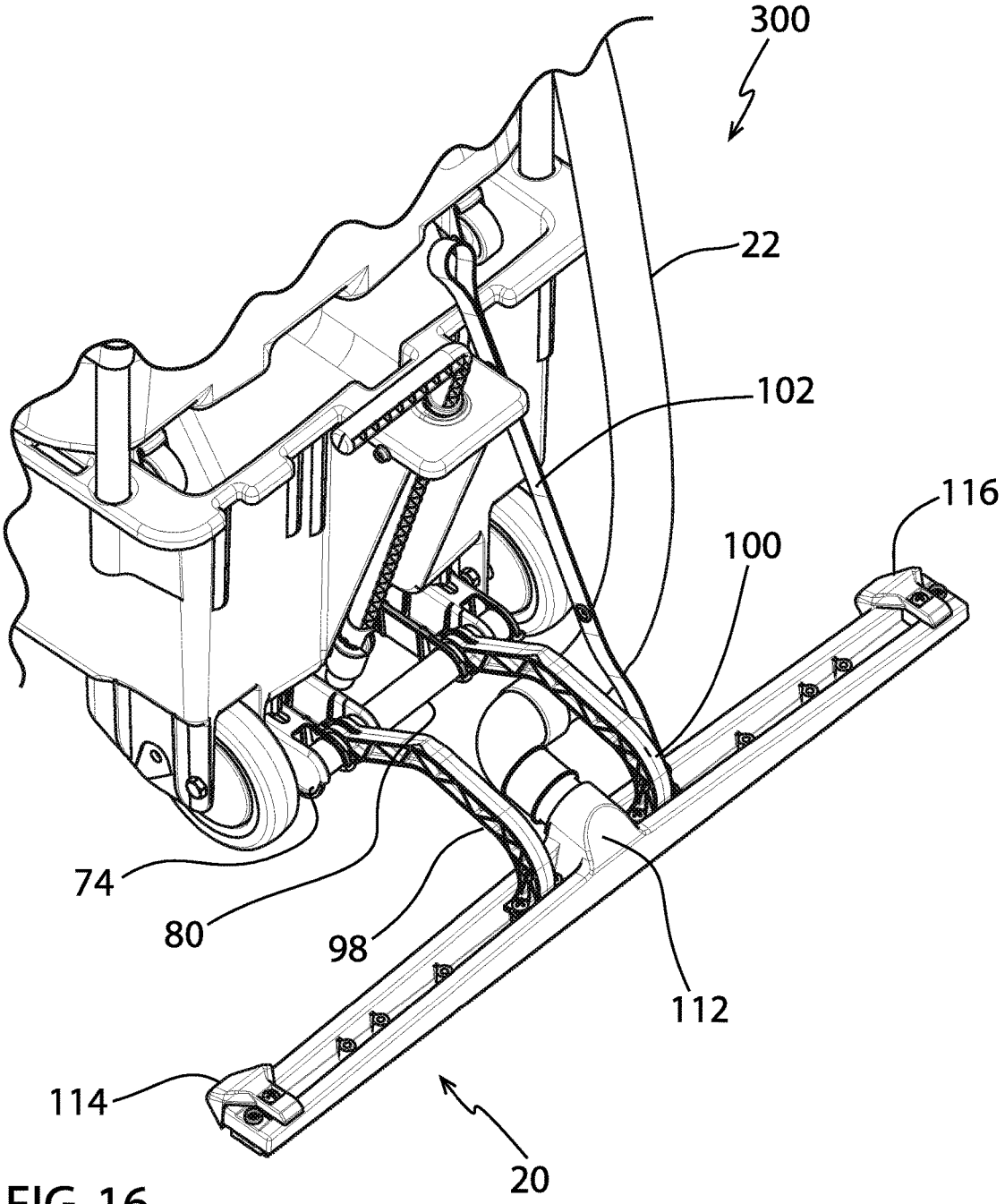
FIG. 16 is a perspective view of a portion of the multi-functional cleaning and floor care system of FIG. 14.

With reference to FIGS. 14-16, the particular multi-functional cleaning and floor care system embodiment 300 shown is identical to system 10 (shown in FIGS. 1-10), except that system 300 does not include the liquid spreader assembly.

In an alternate embodiment (not shown), the liquid spreader assembly and the squeegee head assembly may be fastened to a Kaivac No-Touch Cleaning® machine commercially available from Kaivac, Inc. of Hamilton Ohio. As needed, a bracket may be mounted to the back of a Kaivac No-Touch Cleaning® machine so as to locate the hitch at a suitable height above the floor. A quick disconnect fitting and spray wand may be mounted to the bracket, so that the spray line of the No-Touch Cleaning® machine may be attached to the spray wand. The spray wand may have a suitably sized nozzle such that the cleaning solution from the No-Touch Cleaning® machine may be dispensed at a proper location relative to the liquid spreader assembly and the squeegee head assembly (e.g., in front of both assemblies).

The multi-functional cleaning and floor care system of the present invention may be made using any suitable material (s) and manufacturing technique(s). For example, if desired, the reservoir may be made of polypropylene using injection molding, and the vacuum recovery tank may be made of polyethylene via rotational molding. Also, if desired, the vacuum motor assembly may have the following specifications: 85 inches of lift; 60 cfm; 75 decibels; for the U.S., 110 Volts, 60 Hz, 10 amps; for Universal, 100-240 Volts, 50-60 Hz, 5.5 amps; and heavy duty two-stage vacuum motor.

While the present invention has been illustrated by a description of embodiments, and while the illustrative embodiments have been described in considerable detail, it is not the intention of the inventors to restrict or in any way limit the scope of the following claims to such detail. Additional advantages and modifications readily will appear to those skilled in the art upon a reading of this patent document. The invention, in its broader aspects, is therefore not limited to the specific details, representative apparatus and methods, and illustrative examples shown and described in this patent document. Accordingly, departures may be made from such details without departing from the spirit or scope of the inventors' general inventive concept.

What is claimed is:

1. A multi-functional cleaning and floor care system, comprising:

a trolley bucket assembly including a reservoir and an integral wheeled chassis, the reservoir defining an interior space operable to hold a fresh cleaning liquid;

a wet vacuum assembly including a vacuum recovery tank and a vacuum motor assembly fluidly connected to the vacuum recovery tank;

a spigot fluidly connected to the reservoir interior space, the spigot adjustable between a fully open position and a fully closed position, whereby when the reservoir contains a fresh cleaning liquid, a user may regulate the flow of the fresh cleaning liquid from the reservoir through the spigot by adjusting the spigot;

a liquid spreader assembly connected to at least one of the trolley bucket assembly and the wet vacuum assembly, the liquid spreader assembly including a frame and a spreader pad; and a squeegee head assembly connected to at least one of the trolley bucket assembly and the wet vacuum assembly, the squeegee head assembly fluidly connectable to the vacuum recovery tank, the liquid spreader assembly operable to spread on a floor surface at least a portion of the fresh cleaning liquid from the reservoir, and the squeegee head assembly operable to vacuum at least a portion of the liquid on the floor surface into the vacuum recovery tank.

2. The multi-functional cleaning and floor care system of claim 1 wherein the liquid spreader assembly is connected to the trolley bucket assembly.

3. The multi-functional cleaning and floor care system of claim 2 wherein the liquid spreader assembly is releasably connected to the trolley bucket assembly.

4. The multi-functional cleaning and floor care system of claim 1 wherein the liquid spreader assembly is connectable and disconnectable by a user without the use of a tool.

5. The multi-functional cleaning and floor care system of claim 1 wherein the squeegee head assembly is connected to the trolley bucket assembly.

6. The multi-functional cleaning and floor care system of claim 5 wherein the squeegee head assembly is releasably connected to the trolley bucket assembly.

7. The multi-functional cleaning and floor care system of claim 1 wherein the squeegee head assembly is connectable and disconnectable by a user without the use of a tool.

8. The multi-functional cleaning and floor care system of claim 1 wherein the liquid spreader assembly is moveable to an up position and a down position by a user without the use of a tool.

9. The multi-functional cleaning and floor care system of claim 1 wherein the squeegee head assembly is moveable to an up position and a down position by a user without the use of a tool.

10. A multi-functional cleaning and floor care system, comprising:

a trolley bucket assembly including a reservoir and an integral wheeled chassis, the reservoir defining an interior space operable to hold a fresh cleaning liquid;

a spigot fluidly connected to the reservoir interior space, the spigot adjustable between a fully open position and a fully closed position, whereby when the reservoir contains a fresh cleaning liquid, a user may regulate the flow of the fresh cleaning liquid from the reservoir through the spigot by adjusting the spigot; and a liquid spreader assembly connected to the trolley bucket assembly, the liquid spreader assembly including a frame and a spreader pad, the liquid spreader assembly operable to spread on a floor surface at least a portion of the fresh cleaning liquid from the reservoir.

11. The multi-functional cleaning and floor care system of claim 10 wherein the liquid spreader assembly is connectable and disconnectable by a user without the use of a tool.

12. The multi-functional cleaning and floor care system of claim 10 wherein the liquid spreader assembly is moveable to an up position and a down position by a user without the use of a tool.

13. A multi-functional cleaning and floor care system, comprising:

a trolley bucket assembly including a reservoir and an integral wheeled chassis, the reservoir defining an interior space operable to hold a fresh cleaning liquid;

a wet vacuum assembly including a vacuum recovery tank and a vacuum motor assembly fluidly connected to the vacuum recovery tank;

a spigot fluidly connected to the reservoir interior space, the spigot adjustable between a fully open position and a fully closed position, whereby when the reservoir contains a fresh cleaning liquid, a user may regulate the flow of the fresh cleaning liquid from the reservoir through the spigot by adjusting the spigot; and a squeegee head assembly connected to at least one of the trolley bucket assembly and the wet vacuum assembly, the squeegee head assembly fluidly connectable to the vacuum recovery tank, the squeegee head assembly operable to vacuum at least a portion of the liquid on the floor surface into the vacuum recovery tank.

14. The multi-functional cleaning and floor care system of claim 13 wherein the squeegee head assembly is connected to the trolley bucket assembly.

15. The multi-functional cleaning and floor care system of claim 14 wherein the squeegee head assembly is releasably connected to the trolley bucket assembly.

16. The multi-functional cleaning and floor care system of claim 13 wherein the squeegee head assembly is connectable and disconnectable by a user without the use of a tool.

17. The multi-functional cleaning and floor care system of claim 13 wherein the squeegee head assembly is moveable to an up position and a down position by a user without the use of a tool.

* * * * *